US008928186B2

(12) United States Patent
Manzoli et al.

(10) Patent No.: US 8,928,186 B2
(45) Date of Patent: Jan. 6, 2015

(54) USER INTERFACE DEVICE FOR LOW VOLTAGE SWITCHING DEVICES

(75) Inventors: Romano Manzoli, Caponago (IT); Paolo Bonomi, Petosino (IT)

(73) Assignee: ABB S.p. A., Milan (IT)

( * ) Notice: Subject to any disclaimer, the term of this patent is extended or adjusted under 35 U.S.C. 154(b) by 792 days.

(21) Appl. No.: 13/061,633

(22) PCT Filed: Aug. 3, 2009

(86) PCT No.: PCT/EP2009/060058

§ 371 (c)(1),
(2), (4) Date: Apr. 15, 2011

(87) PCT Pub. No.: WO2010/026013

PCT Pub. Date: Mar. 11, 2010

(65) Prior Publication Data

US 2011/0186408 A1 Aug. 4, 2011

(30) Foreign Application Priority Data

Sep. 3, 2008 (IT) ..... MI2008A1579

(51) Int. Cl.

| | |
|---|---|
| ***H01H 31/10*** | (2006.01) |
| ***H01H 71/04*** | (2006.01) |
| *H01H 71/12* | (2006.01) |
| *H01H 71/74* | (2006.01) |
| *H01H 71/00* | (2006.01) |

(52) U.S. Cl.

CPC ..... *H01H 71/04* (2013.01); *H01H 71/123* (2013.01); *H01H 71/74* (2013.01); *H01H 2071/006* (2013.01)

USPC ..... 307/115

(58) Field of Classification Search

USPC ..... 307/115

See application file for complete search history.

(56) References Cited

U.S. PATENT DOCUMENTS

| | | | | |
|---|---|---|---|---|
| 4,870,531 | A * | 9/1989 | Danek | 361/93.1 |
| 6,292,717 | B1 * | 9/2001 | Alexander et al. | 700/293 |
| 7,925,798 | B2 | 4/2011 | Thudt | |
| 2004/0252421 | A1 * | 12/2004 | Knox et al. | 361/23 |
| 2008/0072078 | A1 * | 3/2008 | Ito | 713/194 |

FOREIGN PATENT DOCUMENTS

| | | | |
|---|---|---|---|
| CN | 101232450 | A | 7/2008 |
| DE | 19812423 | A1 | 9/1999 |
| EP | 1085633 | A1 | 3/2001 |

OTHER PUBLICATIONS

First Examination Report in Application No. 200980134072.2 issued by the Chinese patent Office on Feb. 5, 2013.

* cited by examiner

*Primary Examiner* — Jared Fureman
*Assistant Examiner* — Duc M Pham
(74) *Attorney, Agent, or Firm* — Novak Druce Connolly Bove + Quigg LLP

(57) ABSTRACT

A user interface device for a switching device for low voltage electrical circuits comprising one or more electrical poles and an auxiliary device, provided with a first control unit.

The user interface device, according to the invention, comprises a second control unit capable of storing data and of exchanging data and/or signals with said first control unit.

The user interface device, according to the invention is mechanically associable, in a removable manner, with the switching device.

The user interface device, according to the invention is electrically connectable, in a removable manner, to the aforesaid auxiliary device.

24 Claims, 7 Drawing Sheets

USER INTERFACE DEVICE FOR LOW VOLTAGE SWITCHING DEVICES

CROSS REFERENCE TO RELATED APPLICATIONS

This application is a National Phase filing under 35 U.S.C. §371 of PCT/EP2009/060058 filed on Aug. 3, 2009; and this application claims priority to Application No. MI2008A001579 filed in Italy on Sep. 3, 2008 under 35 U.S.C. §119; the entire contents of all are hereby incorporated by reference.

The present invention relates to the field of switching devices for low voltage electrical circuits, such as automatic circuit breakers, disconnecting switches or contactors.

More in particular, the present invention relates to a user interface device for low voltage switching devices.

As it is widely known, low voltage switching devices (i.e. for voltage values of less than 1 kV AC or 1.5 kV DC) are devices conceived to allow correct operation of specific parts of electrical systems and of the loads operatively associated therewith.

These devices comprise one or more electrical poles, associated with each of which is at least one fixed contact and one moving contact, mutually couplable/decouplable through the action of appropriate control means.

Prior art switching devices typically also comprise auxiliary devices, such as protection and control devices (also known with the term "protection relays"), the main aim of which is to regulate operation of the switching device.

In prior art switching devices, user interface means are associated with these auxiliary devices to allow an operator to interact with the auxiliary device.

Some prior art user interface devices allow functions to control and regulate the auxiliary device to be set.

User interface devices which comprise a plurality of microswitches (also known as DIP switches), movable according to a plurality of predefined positions, are known. By acting manually on these microswitches, the user can set control and regulation parameters usable by the auxiliary device to regulate operation of the switching device.

The technical effect of the position of the single DIP switches is normally schematized by context graphic signs and/or by tables provided by the manufacturer.

The use of these user interface devices present some considerable difficulties.

In fact, the relatively high number of microswitches generally required in order to set the functions of the auxiliary device with sufficient accuracy, the limited dimensions of the microswitches and the difficulty in distinguishing between adjacent DIP switches limit the ergonomics and intuitive use of these user interface devices and can cause errors during setting.

Often, in the absence of sufficiently clear visual indications, it is somewhat difficult in situ to set the exact combination of predefined positions corresponding to the required control and regulation parameters.

Positions of DIP switches which are difficult to reach or badly illuminated, the presence of dirt and deterioration of any graphic signs present can be further causes of errors.

To overcome these drawbacks, in some prior art switching devices, programming of the control and regulation functions of the auxiliary device is executed using a handheld or laptop computer.

These devices are able to communicate with the auxiliary device, through appropriate wired or wireless connections (i.e. of serial type).

Although the use of these tools is advantageous with regard to facilitating programming of the functions of the auxiliary device, it has considerable practical limitations.

In some operating situations, for example if the switching device is located in positions which are awkward or difficult for the user to reach, it can be difficult to use a handheld or laptop computer, in particular if it is necessary to attach a cable for connection to the auxiliary device.

Moreover, simultaneous programming of the functions of several auxiliary devices, as is sometimes required in practice, can be somewhat laborious, given that several devices must be used simultaneously.

Finally, for evident reasons of space, cost and safety, these devices cannot be left permanently connected to a switching device, inside a power distribution board.

Also known are user interface devices, provided with display, fixed solidly to the body of the switching device, typically on the front side thereof.

These interface devices allow the selection of data to be viewed and effective setting of the functions of the auxiliary device, by means of appropriate selection keys or using the display itself, if this is of the touch screen type.

The use of these interface devices is fairly advantageous in terms of facilitating interaction with the auxiliary device.

Unfortunately, production of switching devices provided with these user interface devices at industrial level is relatively complex and costly.

Moreover, use of these user interface means is problematic in switching devices of relatively small size, due to the considerable limits of available space, above all on the front wall. Finally, the U.S. Pat. No. 487,053 describes an interface device for low voltage switches consisting of a display, removably connected to a switch, by means of which it is possible to view and selectively modify parameters relative to operation of this switch.

Interface devices of this type offer very limited performances, given that they merely act as peripherals for entering and viewing data in the control unit of the auxiliary device.

In practice, these interface devices perform the same tasks as a keyboard and/or a monitor of a personal computer.

Therefore, it is not possible to retrieve and save data, such as settings predefined or present in the auxiliary device, and to use this data rapidly to configure other auxiliary devices. Moreover, it is very laborious to preset relatively complex configurations of control and regulation parameters for the auxiliary device.

Finally, in these switching devices it is not possible to access manual setting modes of the functions of the auxiliary device, once the interface device has been removed.

From the considerations above, it is evident how, in the field of low voltage switching devices, there is still the need for user interface devices for low voltage switching devices that allow the functions of the auxiliary device to be easily and effectively preset and, at the same time, are practical to use and economically advantageous for any type of switching device. The market offers numerous types of generic controllers, typically applicable to automated systems for civil or industrial applications.

Examples of these controllers are described in the U.S. Pat. No. 6,944,831 and U.S. Pat. No. 6,725,419. Unfortunately, these devices are substantially not suitable for use in switching devices, taking account of the specific features of a switching device and of the relative auxiliary device, above all with regard to the modes of operation and use in a power distribution board or network.

Therefore, the main aim of the present invention is to provide a user interface device for a low voltage switching device which allows the aforesaid limits and drawbacks to be overcome and, in particular, allows easy, rapid and flexible presetting/programming of the control and regulation functions of the auxiliary device.

This aim, and these and other objects which will be more apparent below, are achieved by a user interface device for a switching device for low voltage electrical circuits, according to claim 1 set forth below.

In its most general definition, the user interface device, according to the invention, is provided with a control unit by means of which it is possible to store data locally and exchange data with the control unit of the auxiliary device.

Preferably, the control unit of the user interface device is capable of transmitting sets of data to the auxiliary device, automatically and/or with mode selectable by the user.

Therefore, this allows off-line programming of the data to be sent to the control unit of the auxiliary device, without requiring the presence of a connection with the control unit of the auxiliary device.

In this manner, the functions of the auxiliary device are easy to set, given that sets of predefined data, advantageously relative to control and/or regulation functions of the auxiliary device, can be stored, and processed if necessary, in the interface device, according to the present invention, and then easily transmitted to the control unit of the auxiliary device.

The data transmitted by the user interface device, according to the invention, can advantageously be used by the auxiliary device, according to modes selectable by the user. Preferably, the user interface device, according to the present invention, is also capable of sending control signals to the auxiliary device and/or of interactively modifying the operating parameters of the auxiliary device, therefore using online mode.

Preferably, the user interface device, according to the present invention, is also capable or receiving data from the control unit of the auxiliary device and of processing and saving the data thus received locally, so that they are readily available for subsequent analysis or use (for example on other switching devices).

Preferably, the user interface device, according to the present invention, also comprises a display for viewing data and/or signals.

Advantageously, the user interface device, according to the present invention, also comprises means for selecting data and/or signals, for example to select the data input into and/or output from said auxiliary device or to perform selective viewing.

The user interface device, according to the invention, is mechanically associated, in a removable manner, with the enclosure containing the switching device and is electrically associated, in a removable manner, with the auxiliary device.

The user interface device, according to the invention, can therefore be used by the operator as a mobile interface of the auxiliary device, as a mobile accessory for programming the functions thereof, as a carrier for data to be uploaded into the auxiliary device or, optionally, as a carrier for data downloaded from the auxiliary device.

For this purpose, the user interface device, according to the invention, is advantageously dimensioned in a manner such as to be easily transported by an operator, who can thus use it as a true working tool.

On the other hand, the user interface device, according to the invention, is advantageously dimensioned in a manner such as to allow mounting on the switching device, without significantly increasing the overall dimensions thereof. Therefore, it can be easily used as interface unit permanently mounted on a switching device.

From the above it is clear how the user interface device, according to the invention, has dual validity as a "portable" tool for the operator, according to the dictates of ease and simplicity of use, and as "resident" accessory for the switching device, in conformity with the aesthetic features or canons of design of the switching device.

Naturally, the above translates into considerably easy practical use, in particular with relatively complex power distribution boards or networks.

Further features and advantages of the invention will be more apparent from the description of preferred, but not exclusive, embodiments of the user interface device, according to the invention, shown by way of example in the accompanying drawings, wherein.

Figure 1:
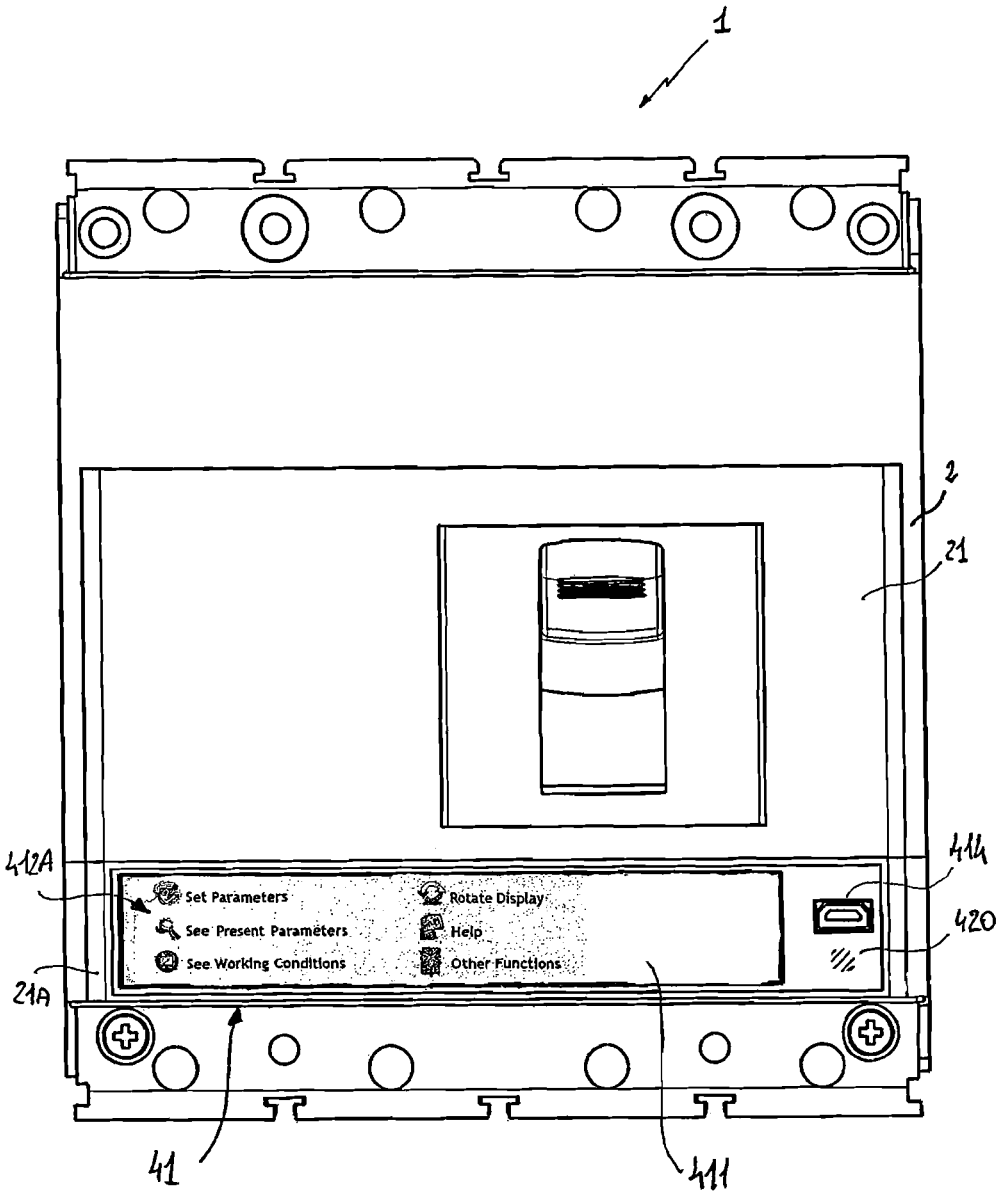
FIG. 1 is a front view of a switching device on which a user interface device, according to the invention, is mounted.

With reference to the aforesaid figures, the present invention relates to a user interface device 41 for a switching device 1 for low voltage electrical circuits.

The switching device 1 can be constituted, for example, by an automatic circuit breaker, a disconnecting switch, a contactor or other similar devices.

The switching device 1 comprises one or more electrical poles, each of which comprises one or more pairs of contacts actuable by appropriate control means between at least a first coupling position and a second separation position.

The switching device 1 comprises a containing enclosure 2 advantageously provided with a front wall 21 and a pair of lateral walls 22.

The switching device 1 comprises at least one auxiliary device 3 for control and/or setting operation of the switching device 1.

The auxiliary device is preferably associated inferiorly with the portion of switching device 1 in which the electrical contacts thereof are positioned.

The auxiliary device 3 is preferably constituted by a protection relay, advantageously operatively connected to one or more sensors and/or actuators 7.

More in general, the term "auxiliary device" can indicate any device integrated in the switching device 1 for the purpose of controlling and regulating operation thereof or adding new functions.

Preferably, the auxiliary device 3 comprises a first control unit 310A, advantageously equipped with at least one microprocessor device 310 and one or more memory spaces 311. The control unit 310A advantageously interfaces with the sensors and/or actuators 7 of the switching device 1, with which it can exchange control signals and/or data signals.

The auxiliary device 3 also comprises a power stage 314 suitable to provide electrical power to the control unit 310A to the other circuits of the auxiliary device 3.

Advantageously, the auxiliary device 3 comprises a first communication port 313, preferably a female USB (Universal Serial Bus) connector.

The communication port 313 is advantageously connected to the power stage 314 and to the control unit 310A. It can therefore easily exchange data signals, control signals and electrical power with devices external to the auxiliary device 3.

The interface device 41, according to the invention, is advantageously mechanically associable in a removable manner with the switching device 1, in particular with the front wall 21 thereof.

Advantageously, the interface device 41 is mounted on the front wall 21A of the auxiliary device 3, on the lower portion of the front wall 21 of the switching device 1.

As a rule, however, the interface device 41 could be mounted on any other area of the walls of the enclosure 2.

Figure 2:
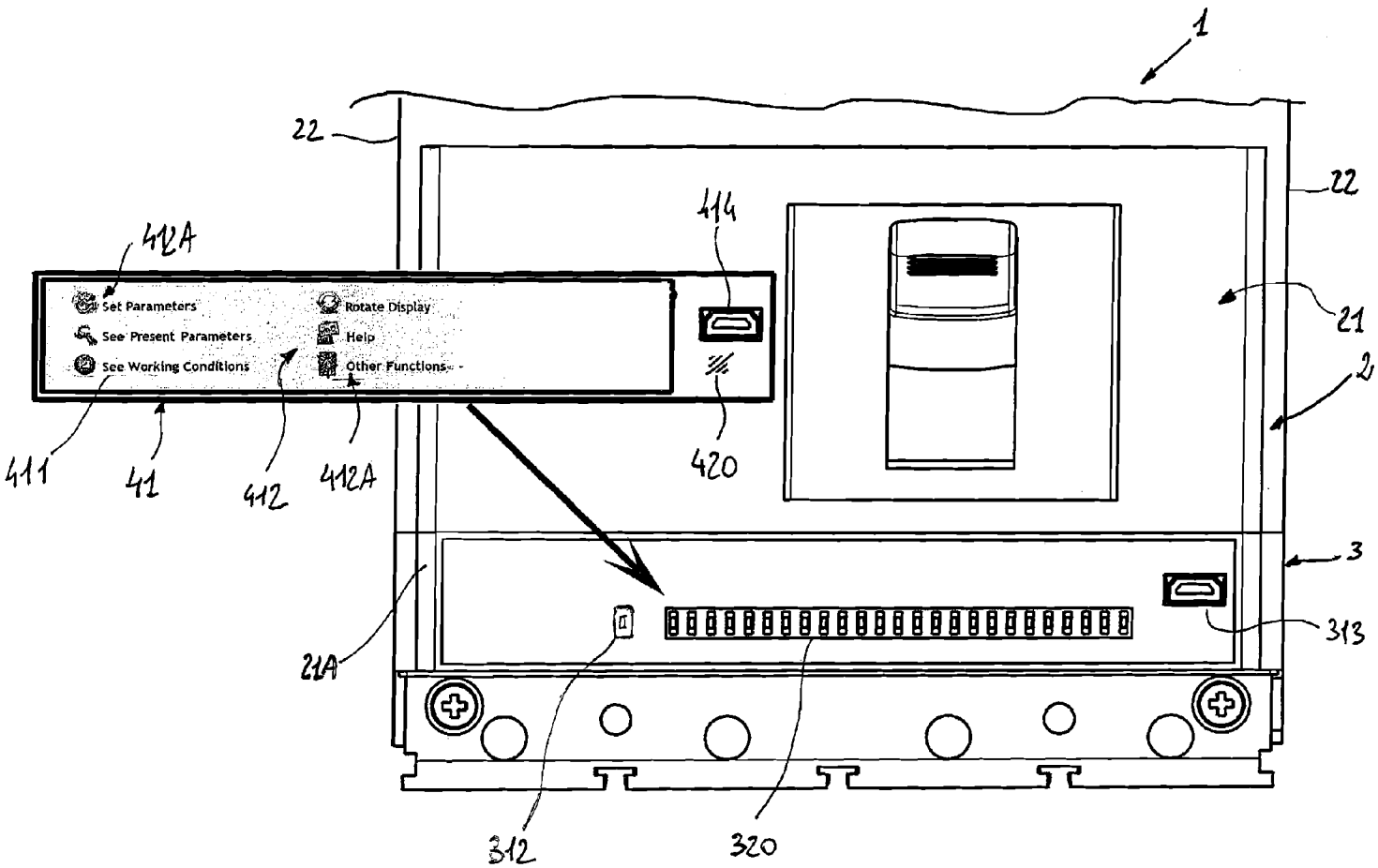
FIG. 2 is a partial front view of a switching device and of a user interface device, according to the invention, associable with said switching device.
Figure 3:
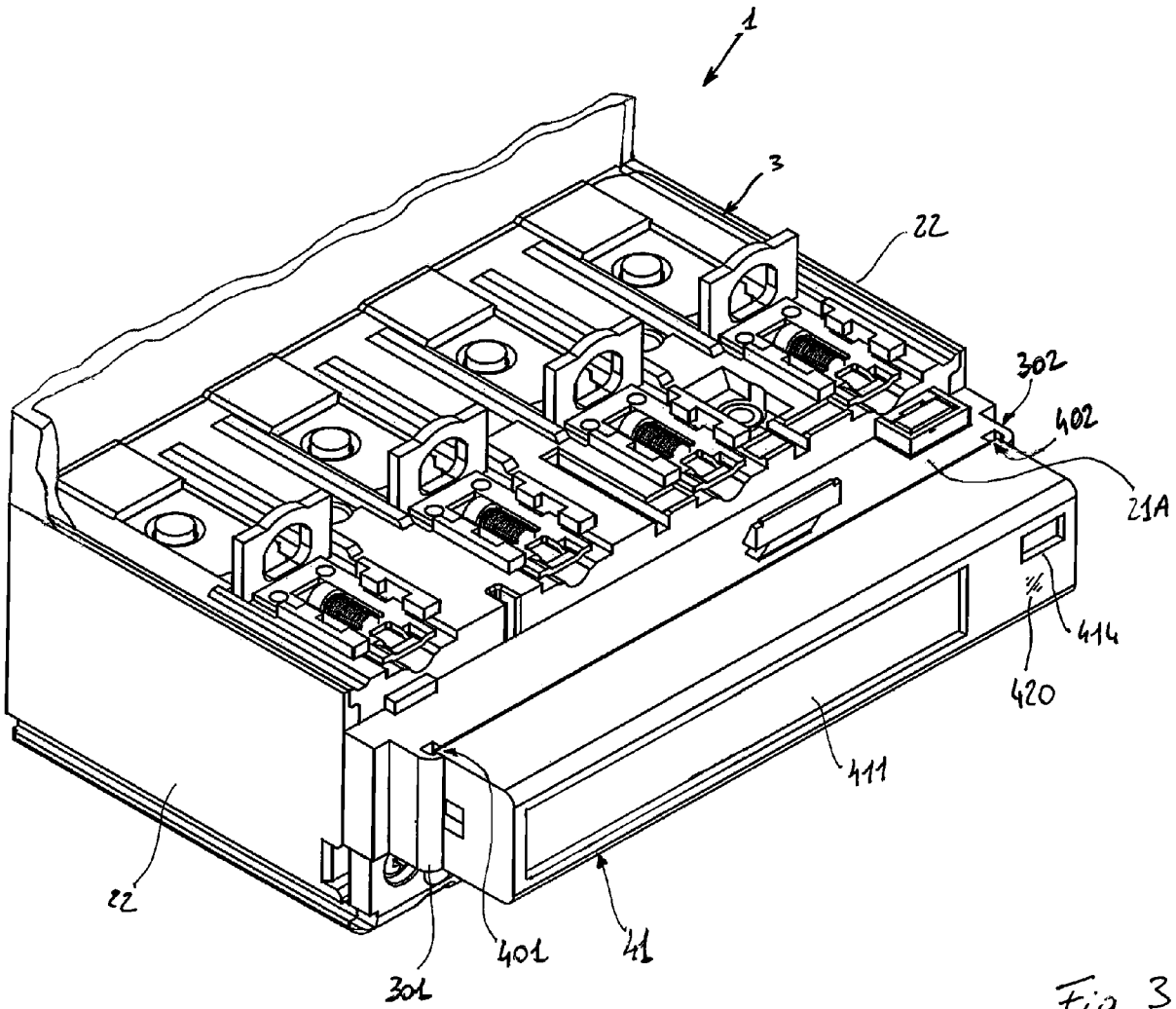
FIG. 3 is a partial perspective view in a cross section of a switching device on which a user interface device, according to the invention, is mounted.
Figure 4:
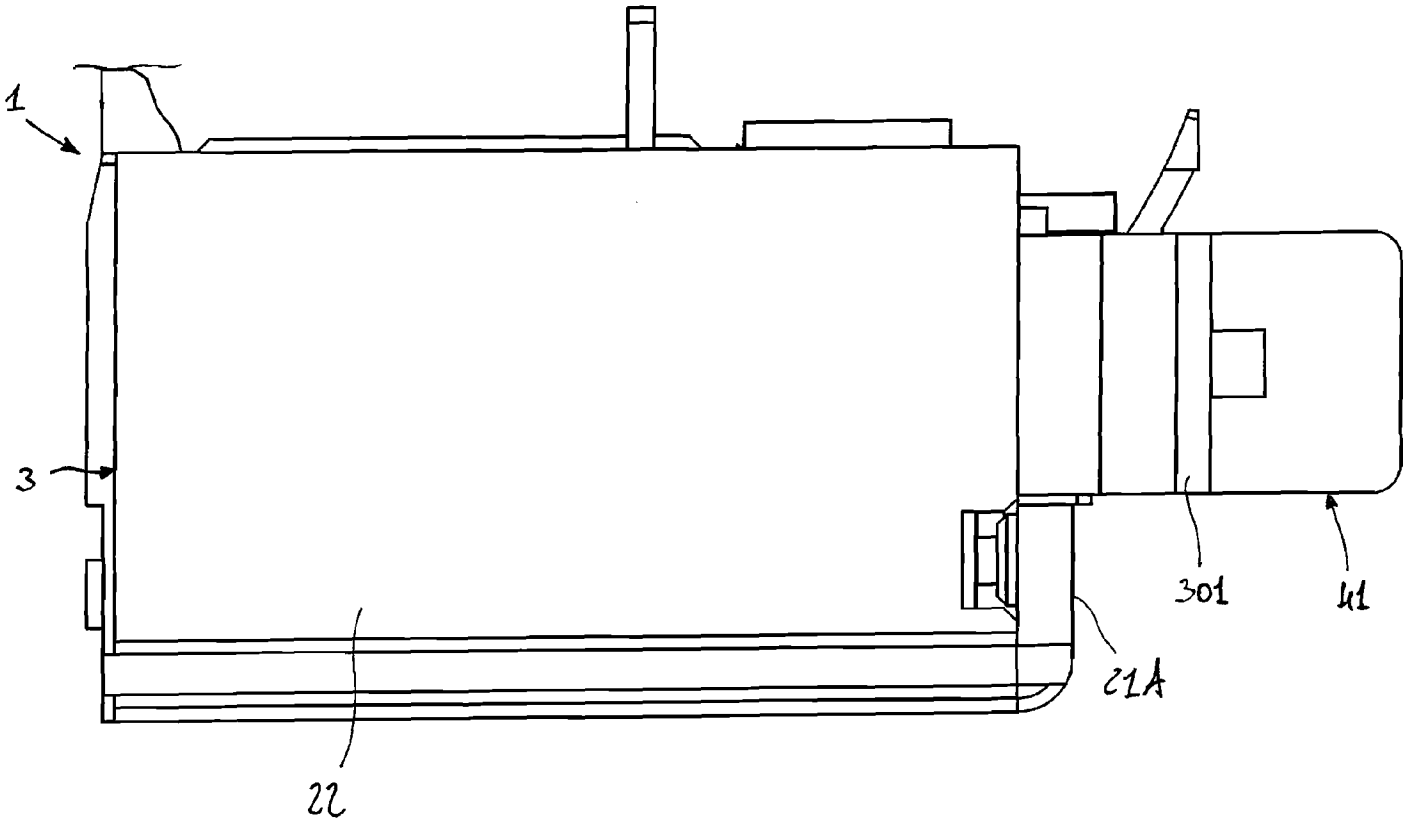
FIG. 4 is a partial side view of the switching device of FIG. 3.

Preferably, the interface device 41 comprises shaped edges and/or couplings 401 and 402 intended to couple with corresponding grooves 301*e* 302, produced on the front wall 21A of the auxiliary device (FIG. 2).

Other removable mechanical connection means of known type could be used, according to requirements.

The interface device 41, according to the invention, is electrically connectable, in a removable manner, to the auxiliary device 3.

For this purpose, it comprises a second communication port 413, advantageously comprising a male USB connector, intended to couple with the female USB connector 313 of the auxiliary device 3.

The interface device 41 comprises a second control unit 415A, advantageously comprising at least one microprocessor unit 415 and one or more memory spaces 417.

The control unit 415A is capable of storing data on a local level, i.e. of storing information in the memory spaces 417.

Moreover, the control unit 415A is capable of exchanging data and/or signals with the control unit 310A.

The control unit 415A advantageously comprises first processing means 416 suitable to manage the transmission of data and/or signals, for example to the auxiliary device 3 or to other devices connected thereto.

These data can advantageously comprise one or more predefined configurations relative to the control and regulation functions required for the auxiliary device 3, i.e. sets of control and regulation parameters and variables usable by the auxiliary device 3.

The control unit 415A is also capable of sending the auxiliary device 3 control signals or other types of data, such as data and/or parameters relative to operation of the switching device 1.

Preferably, the control unit 415A is capable of receiving data and/or signals from the auxiliary device 3 and/or from other devices connected thereto.

In fact, the control unit can advantageously comprise second processing means 416A suitable to manage the reception of data and/or signals, for example input from the control unit 310A. The control unit 415A is preferably capable of independently processing, on a local level, data and/or signals. For this purpose, it can comprise third processing means 416 suitable to locally process data and/or signals, for example in order to process input/output information or store information in the memory spaces 417.

Figure 5:
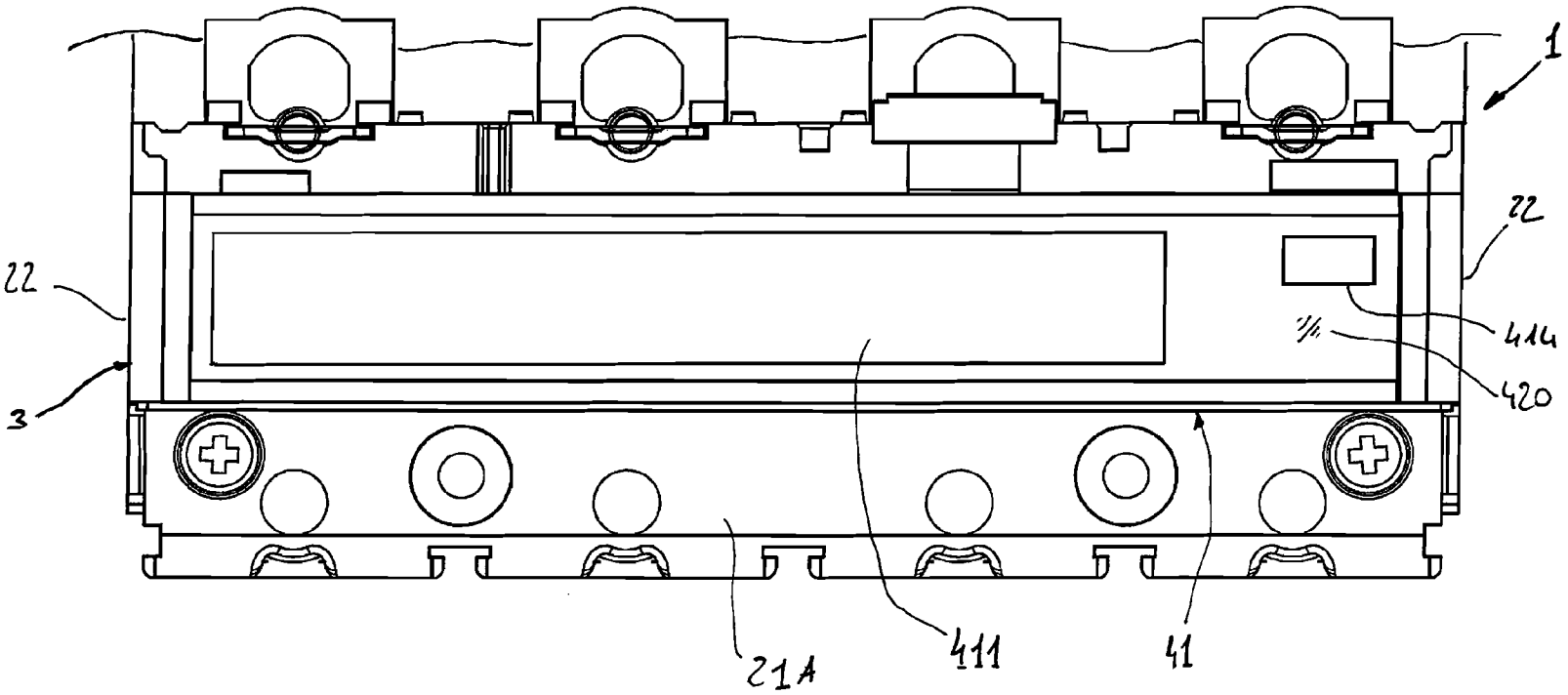
FIG. 5 is a partial front view of the switching device of FIG. 3.
Figure 6:
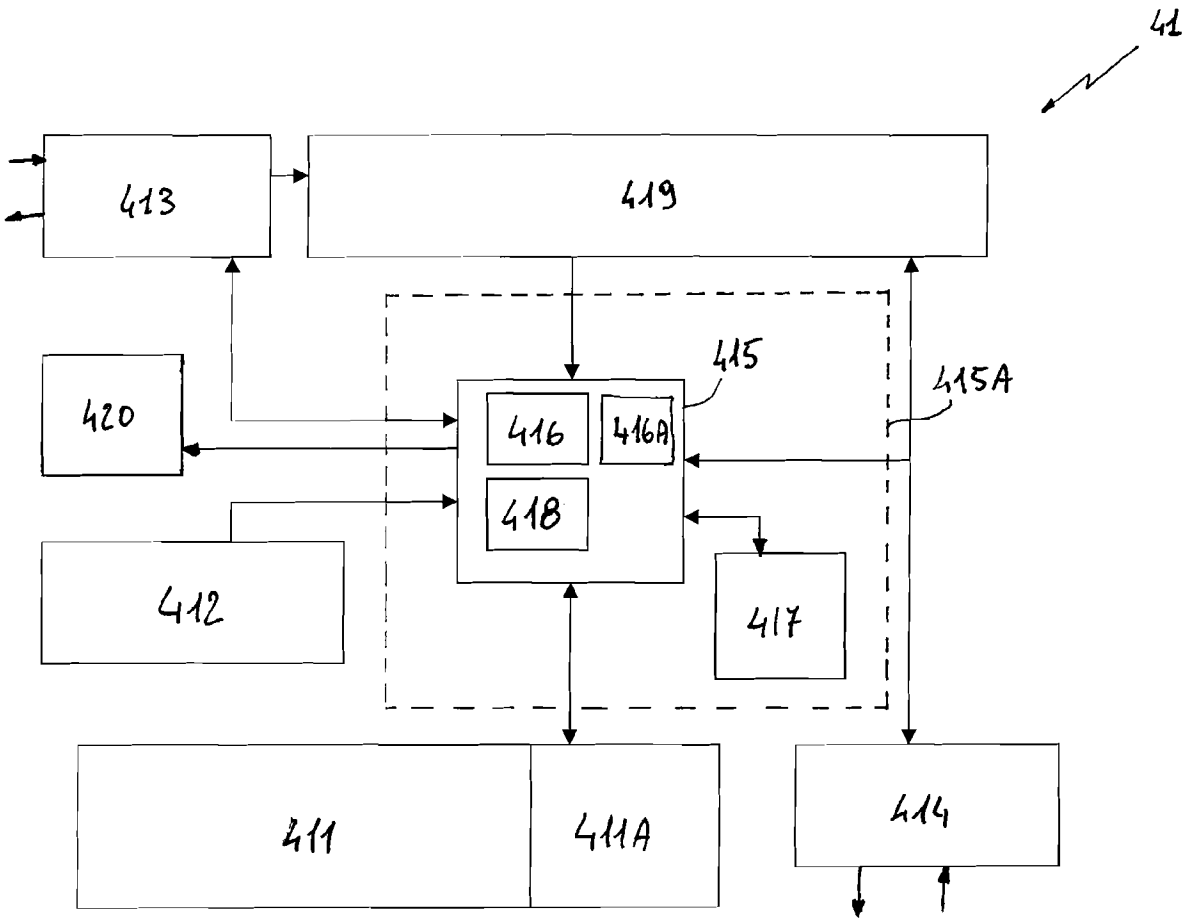
FIG. 6 is a block diagram illustrating the structure of the user interface device, according to the invention.
Figure 7:
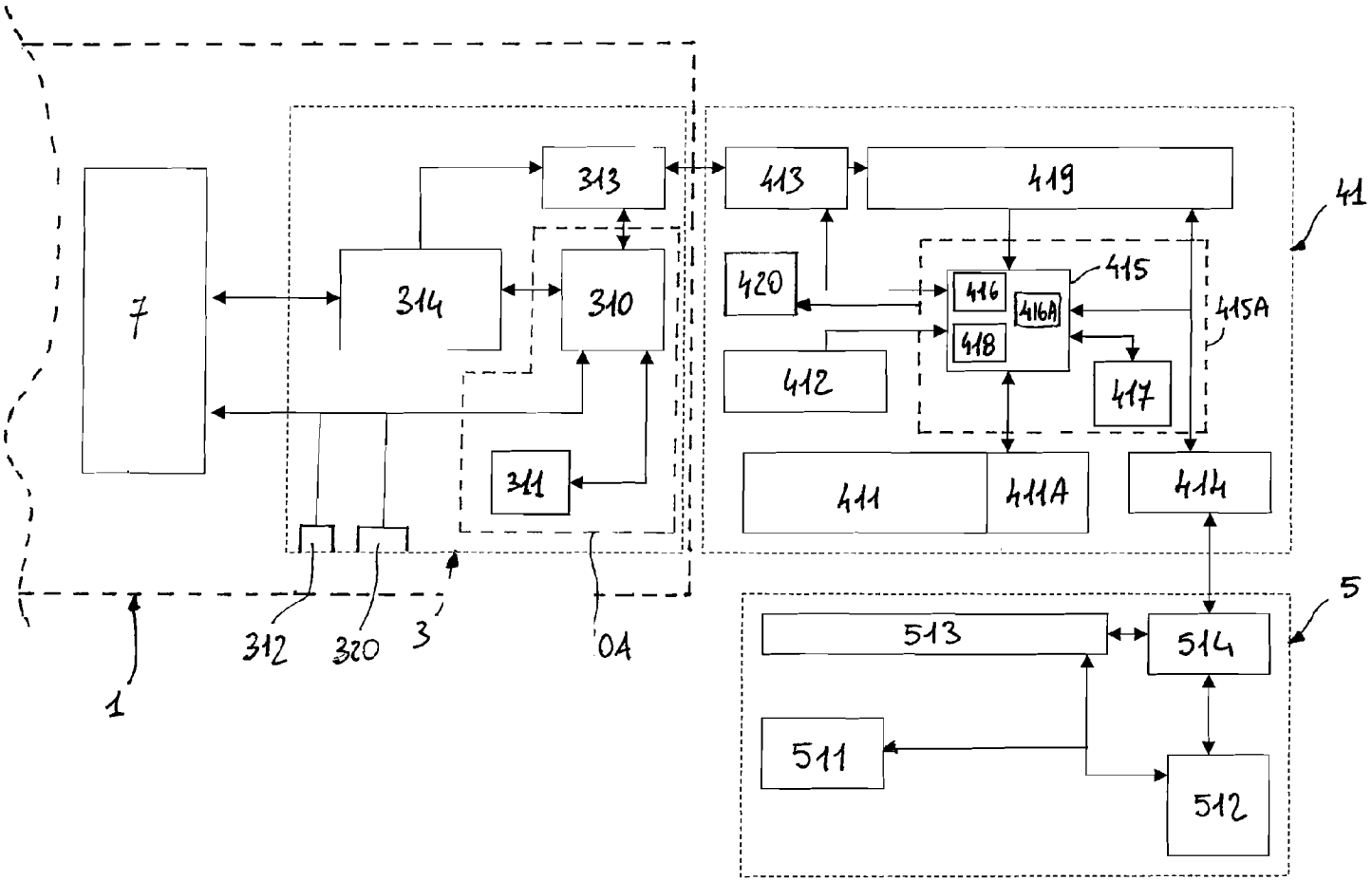
FIG. 7 is a block diagram illustrating the structure of the user interface device, according to the invention, of an auxiliary device and of an external peripheral unit.

The processing means 416, 416A and 418 can be produced by means of independent circuit blocks of the control unit 415A or, preferably, as shown in FIGS. 5 and 6, they advantageously comprise one or more programs and/or routines and/or software modules suitable to be executed by the microprocessor unit 415.

In a preferred embodiment, the interface device 41 comprises a display 411 for viewing data or information.

The display 411 can be of any available type, i.e. monochrome, or active matrix and have any shape, even different from the rectangular shape shown in the aforesaid figures.

The control unit 415A drives the display 411 by means of an appropriate control driver 411A. Preferably, the display 411 is back-lit, in order to ensure effective viewing of data and information in any environmental condition.

The switching device 41 preferably comprises means for selecting data and/or signals 412, for example data and/or signals input into and/or output from the second control unit 415A.

By acting on the selection means 412, the user can, for example, select the data to be viewed by means of the display 411 or send control signals to the control unit 415.

The selection means 412 can comprise one or more hardware buttons operable by the user, such as a sequential selection key, or a pair of selection keys for subsequent levels, or one or more pairs of direction keys, or one or more multifunction keys or joysticks.

Alternatively, as shown in FIG. 1, the selection means 412 can be integrated with the display 411, according to the known operating modes of a touch screen display. In this case, the selection means 412 can comprise one or more icons 412A through which to interact with the control unit 415A.

In a preferred embodiment, the selection means 412 can also be used to select the direction and side for viewing information on the display 411, thereby allowing the user to choose the most suitable viewing direction or side, in relation to the installation configuration of the switching device 1, without varying the position of the display 411 with respect to the enclosure 2.

The transmission of data from the control unit 415A to the auxiliary device 3 can take place immediately, as soon as the interface device 41 is mounted on the switching device 1 and electrically connected to the auxiliary device 3.

However, the transmission of data output from the control unit 415A preferably takes place according to methods selectable by the user by means of appropriate first enabling means.

For example, the user can use the aforesaid first enabling means to enable the control unit 415A to automatically transmit predefined sets of data (already stored in the memory spaces 417) to the auxiliary device 3.

The first enabling means can comprise, for example, one or more dedicated enable buttons operable by the user when wishing to enable data transmission.

Advantageously, the described selection means 412 can be used as first means to enable data transmission.

Preferably, the data transferred to the auxiliary device 3 can also be used by the control unit 310 thereof, according to modes and times selectable by the user.

Advantageously, second enabling means are provided, to enable the auxiliary device 3 to use the data transmitted by the interface device 41.

The user can use the aforesaid second enabling means to enable the control unit 310 of the auxiliary device 3 to use the data transmitted by the control unit 415A, at any moment, even distant in time from the period in which the aforesaid data are transmitted.

The second enabling means preferably comprise a microswitch 312 positioned on the front wall 21A of the auxiliary device 3.

For greater compactness of the front wall 21 of the switching device 1, the microswitch 312 is preferably positioned in a manner such as to be covered by the interface device 41 when the latter is mounted on the switching device 1.

The microswitch 312 can then be operated by the user, once the data has been loaded into the auxiliary device 3 and after removing the interface device 41.

According to an alternative embodiment, the described selection means 412 can be used as second enabling means to enable the auxiliary device 3 to use the data transmitted by the interface device 41.

In this case, the user can enable the control unit 310 without removing the interface device 41 from the switching device 1.

Preferably, the interface device 41 also comprises acoustic signaling means 420 of the beeper type to improve selection of data and/or controls with acoustic signals for confirmation or to provide alarm signals, for example in the case of programming errors or malfunction. Preferably, the interface device 41 comprises a power stage 419 suitable to manage the power supply of the user interface device 41, in particular of the control unit 415A and of the display 411.

The power stage 419 is advantageously connected to the USB communication port 413 so as to receive electrical power from the auxiliary device 3.

The power stage 419 can advantageously comprise a step-up circuit, not shown, suitable to take the input electrical power signal received to higher voltage values, such as voltage values suitable to supply the display 411.

Moreover, the power stage 419 can advantageously comprise a buffer battery.

Preferably, the interface device 41 comprises a third communication port 414, suitable to electrically connect, in a removable manner, the interface device 41 and/or the auxiliary device 3 to a peripheral device 5.

The communication port 414 advantageously comprises a female USB connector, advantageously connected to the control unit 415A, to the power stage 419 and to the USB port 413.

This solution is particularly advantageous given that it provides the user with an input port to the interface device 41 and/or to the auxiliary device 3 which is always available.

The peripheral device 5 can in fact communicate directly with the auxiliary device 3 and/or with the control unit 415A and be supplied by the auxiliary device 3 by means of the USB ports 313, 413 and 414.

The peripheral device 5 can be constituted, for example, by a test device comprising a third microprocessor control unit 512 and a power stage 513, to which a fourth communication port 514 is connected, preferably a female USB connector, which can be coupled with the communication port 414 of the interface device 41.

Advantageously, the device 5 also comprises a display 511 driven by the control unit 512. Alternatively, the peripheral device 5 can be realized by a handheld or laptop computer.

The interface device 41 can be used on any type of switching device, regardless of the presence of other prior art interface devices.

For example, as shown in FIGS. 1 and 6, a further interface device 320, of the DIP switch type, could be associated with the auxiliary device 3, advantageously connected to the control unit 310 of auxiliary device 3.

To increase the compactness of the front wall 21 of the switching device 1, the interface device 320 is preferably positioned in a manner such as to be covered by the interface device 41 when this is mounted on the switching device 1.

This is therefore operable by the user once the interface device 41 is removed.

The interface device 41, according to the present invention, allows the preset aim and the objects to be fully achieved.

The interface device 41 can be electrically and mechanically connected in a removable manner to the switching device 1.

It can be mounted on/removed from a switching device 1 with a simple operation by the user and is therefore easy to use as mobile interface unit for one or more switching devices.

For this purpose, the user interface device 41 is advantageously dimensioned in a manner such as to be easily transportable by a user.

On the other hand, the interface device 41 can also be used as permanent interface of a switching device.

The interface device 41 is dimensioned in a manner such as to have a very compact structure. In this manner, once mounted in the operating position, it is capable of integrating structurally with a wall of the enclosure 2 of the switching device 1 (in particular with the front wall 21), without significantly increasing the overall dimensions of this switching device.

Due to the functional features described above the interface device 41 is very flexible and easy to use, making it particularly suitable for use in complex power distribution boards or networks.

This flexible use is augmented by the fact that the interface device 41 can be used in any switching device 1, even in the case in which other user interface devices are already present.

A further advantage derives from the fact that the interface device 41 can allow the connection of tools or peripheral devices to the auxiliary device 3, although it is mounted on the switching device 1.

The marked structural integrability of the interface device 41 makes it particularly suitable for use also in switching devices of limited size, with limited spaces available on the front wall. The interface device 41 greatly facilitates programming of the control and regulation functions of the auxiliary device.

For example, it allows off-line programming of the functions of the auxiliary device 3.

The user can thus store predefined control and regulation configurations for the auxiliary device 3 in the interface device 41, and transmit these configurations, enabling use thereof according to requirements.

In this context, the interface device 41 can be used as a true mobile unit for programming the auxiliary device 3.

Moreover, the interface device 41 also allows constant interaction with the auxiliary device 3 and can be used as a permanent control panel associated with the auxiliary device 3.

The interface device can also be used as an actual data carrier, for example to download update software, or other data, to the auxiliary device, or to acquire information from the auxiliary device 3 relative to operation of the switching device 1, such as data detected by the sensors 7.

The interface device 41 could also be used for secondary functions, for example as peripheral device for sending control signals to the auxiliary device 3 or simply for viewing data and information concerning operation of the auxiliary device and/or of the switching device 1.

Due to the presence of the display 411, driven by the control unit 415, the interface device 41 allows easy viewing of the input and output data sent/received and can integrate the most up-to-date functions of data viewing and selection.

Notwithstanding the considerable advantages regarding function and practical use listed above, the interface device 41 has a relatively simple structure which is suitable to be produced easily and inexpensively at industrial level.

The user interface device thus conceived is susceptible to numerous modifications and variants, all falling within the inventive concept; moreover all details can be replaced by other technically equivalent details.

In practice, the materials used and the contingent dimensions and forms can be any, according to requirements and to the state of the art.

The invention claimed is:

1. A user interface device mountable on a circuit switch for low voltage electrical circuits, comprising:

said circuit switch including one or more electrical poles, each including at least one pair of contacts actuable between a coupling position and a separation position;

an auxiliary device configured to control and/or regulate operation of said circuit switch, said auxiliary device including a first control unit;

a second control unit capable of storing data and exchanging data and/or signals with said first control unit, said user interface device being mechanically associable, in a removable manner, with said circuit switch, and being electrically connectable, in a removable manner, to said auxiliary device;

wherein when said second control unit is removed from the circuit switch the first control unit remains connected to the circuit switch.

2. The user interface device, according to claim 1, further comprising at least one display for viewing data and/or signals.

3. The user interface device, according to claim 1, wherein said second control unit comprises first processing means suitable to manage the transmission of output data and/or signals.

4. The user interface device, according to claim 1, wherein said second control unit comprises second processing means suitable to manage the reception of input data and/or signals.

5. The user interface device, according to claim 1, wherein said second control unit comprises third processing means suitable to locally process data and/or signals.

6. The user interface device, according to claim 1, wherein further comprising first enabling means suitable to enable the transmission of data and/or signals.

7. The user interface device, according to claim 1, wherein further comprising second enabling means suitable to enable said first control unit for the use of data transmitted by said second control unit.

8. The user interface device, according to claim 1, wherein further comprising at least one communication port to electrically connect, in a removable manner, to a peripheral device.

9. The user interface device, according to claim 8, wherein said at least one communications port electrically connects, in a removable manner, said peripheral device to said auxiliary device.

10. The user interface device, according to claim 1, wherein said auxiliary device is a protection relay.

11. A circuit switch comprising a user interface device, according to claim 1.

12. A switch device for low voltage electrical circuits, comprising:

a circuit switch including one or more electrical poles, each comprising at least one pair of contacts actuable between a coupling position and a separation position;

an auxiliary device for control and/or regulation of the operation of said circuit switch, said auxiliary device including a first control unit; and a user interface device comprising a second control unit capable of storing data and exchanging data and/or signals with said first control unit, said user interface device being mechanically associated, in a removable manner, with said circuit switch, and being electrically connected, in a removable manner, to said auxiliary device;

wherein when the second control unit is removed from the circuit switch, the first control unit remains connected to the circuit switch.

13. The user interface device, according to claim 2, wherein said second control unit comprises first processing means suitable to manage the transmission of output data and/or signals.

14. The user interface device, according claim 2, wherein said second control unit comprises second processing means suitable to manage the reception of input data and/or signals.

15. The user interface device, according claim 3, wherein said second control unit comprises second processing means suitable to manage the reception of input data and/or signals.

16. The user interface device, according claim 2, wherein said second control unit comprises third processing means suitable to locally process data and/or signals.

17. The user interlace device, according claim 3, wherein said second control unit comprises third processing means suitable to locally process data and/or signals.

18. The user interface device, according claim 4, wherein said second control unit comprises third processing means suitable to locally process data and/or signals.

19. The user interface device, according to claim 2, further comprising first enabling means suitable to enable the transmission of data and/or signals.

20. The user interface device, according to claim 3, further comprising first enabling means suitable to enable the transmission of data and/or signals.

21. The device of claim 1, wherein the first control unit is integrally mounted in the circuit switch.

22. The device of claim 19, wherein the first control unit is integrally mounted in the circuit switch.

23. The device of claim 1, wherein the circuit switch is an automatic circuit breaker, disconnecting switch or contactor.

24. The device of claim 12, wherein the circuit switch is an automatic circuit breaker, disconnecting switch or contactor.

* * * * *